US006287074B1

(12) United States Patent
Chancellor

(10) Patent No.: US 6,287,074 B1
(45) **Date of Patent: *Sep. 11, 2001**

(54) MECHANICAL SEAL FOR SHAFTS AND AXLES

(75) Inventor: Dennis H. Chancellor, Woodland Hills, CA (US)

(73) Assignee: NATE International, Woodland Hills, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/831,450

(22) Filed: Mar. 31, 1997

(51) Int. Cl.[7] ..... F04D 29/12

(52) U.S. Cl. ..... 415/231; 415/111; 415/113; 415/230; 417/423.11; 417/423.12

(58) Field of Search ..... 415/111, 112, 415/113, 168.2, 170.1, 174.2, 230, 231; 417/423.11, 355, 356, 423.12; 277/368, 369, 390, 370, 379, 399, 358; 384/477, 481, 483, 482

(56) References Cited

U.S. PATENT DOCUMENTS

| | | | | |
|---|---|---|---|---|
| 2,077,881 | * | 4/1937 | Gits | 384/481 |
| 2,465,499 | * | 3/1949 | Voytech | 277/379 |
| 2,549,112 | * | 4/1951 | Miller | 277/390 |
| 2,653,837 | * | 9/1953 | Voytech | 277/390 |
| 2,911,241 | * | 11/1959 | Horvath et al. | 384/481 |
| 2,981,558 | * | 4/1961 | Jensen | 277/390 |
| 3,079,605 | * | 2/1963 | Thomas et al. | 277/368 |
| 3,218,110 | * | 11/1965 | Conner | 384/481 |
| 3,540,833 | * | 11/1970 | Talamonti | 415/231 |
| 3,667,870 | * | 6/1972 | Yoshida et al. | 417/423.11 |
| 3,704,020 | * | 11/1972 | Huhn | 277/368 |
| 3,746,472 | * | 7/1973 | Rupp | 417/423.11 |
| 4,253,713 | * | 3/1981 | Chambers, Sr. | 384/481 |
| 5,478,222 | * | 12/1995 | Heidelberg et al. | 417/423.11 |
| 5,605,436 | * | 2/1997 | Pedersen | 415/231 |
| 5,630,699 | * | 5/1997 | Kirby et al. | 415/230 |

FOREIGN PATENT DOCUMENTS

| | | | | |
|---|---|---|---|---|
| 539718 | * | 4/1957 | (CA) | 415/231 |
| 449584 | * | 8/1913 | (FR) | 384/477 |
| 719222 | * | 12/1954 | (GB) | 384/483 |

* cited by examiner

*Primary Examiner*—Christopher Verdier
(74) *Attorney, Agent, or Firm*—Fish & Associates, LLP

(57) ABSTRACT

In a centrifugal pump, a sealing ring is affixed to the rotating shaft through which pumpate flows, and a non-rotating, axially slidable sealing member is biased against the sealing ring. In preferred embodiments the slidable sealing member sealingly additionally engages a second sealing member which is stationary with respect to the motor housing. In particularly preferred embodiments slidable sealing members are positioned near each end of the motor housing, with the sealing ring interposed between a rolling bearing and a slidable sealing member.

7 Claims, 8 Drawing Sheets

MECHANICAL SEAL FOR SHAFTS AND AXLES

1. FIELD OF THE INVENTION

The present invention relates generally to rotating shaft devices, including motors, axles, centrifugal pumps, and more specifically to mechanical seals utilized in such devices.

2. BACKGROUND OF THE INVENTION

Rotating shaft devices are used extensively throughout the world, and have been improved many times over the course of many years. However, as described below with respect to centrifugal pumps, rotating shaft devices still have considerable problems which have not been resolved.

Centrifugal pumps typically contain an impeller coupled to a rotating shaft. In conventional centrifugal pumps a pumpable fluid (pumpate) is pulled into the eye of the impeller where the fluid is spun radially outwards into the volute space. Pressure builds in the volute space until the pressure is able to overcome the discharge resistance, at which point the pumpate exits the pump.

It is well known in the art to use either a soild or a hollow shaft, and to rotate the shaft using electromotive forces. Typically, a rotor is affixed to the outer circumference of the shaft of either configuration for this purpose, and the rotor is acted upon by a concentric stator. Either arrangement raises the possibility that some of the pumped fluid will leak from spaces between various stationary and rotating components.

It is known to eliminate the leakage problem by utilizing a canned pump (not shown). In such pumps the rotor and shaft bearings are contained within a "can" inside the pumpate flow stream. Canned pumps are typified by U.S. Pat. No. 3,667,870 to Yoshida, Canadian Pat. no. 733,312 to Penman, and more recently U.S. Pat. No. 5,356,273 to Nixon. While canned pump designs are effective in addressing the leakage problem, they are inherently inefficient because the wall of the "can" is interposed between the rotor and the stator. Such a design necessarily reduces the efficiency of electromagnetic energy transmission.

In centrifugal pumps other than canned pumps, leakage is commonly addressed using mechanical seals. Prior art FIG. 1 depicts a generic centrifugal pump 110 having a rotating shaft 120 to which is affixed an impeller 130. A rotor 140 is concentric about the rotating shaft 120, and a motor stator 150 is concentric about rotor 140. A volute 160 is held away from the motor assembly by close couple frame 111. Volute 160 partially encloses the impeller 130, and has suction inlet 15 and discharge outlet 165. Fluid enters the pump in the direction of arrow 105. Centrifugal pump 110 has a generic mechanical seal 110A which includes non-rotating secondary seals 170 and 171, and rotating secondary seals 172 and 173. In the relationship shown, non-rotating secondary seal 170 seals non-rotating seal 171, and rotating seal 172 seals rotating secondary seal 173. A rotating pressure spring 174 biases seal 171 against seal 172, and a spring cup 175 helps stabilize the pressure spring 174.

For centrifugal pumps of the type shown in FIG. 1, there are logically only two categories of points A and B (shown) at which the seals can be positioned with respect to the rotating shaft 120 entering the volute to prevent leakage. In either position mechanical seals are positioned to provide a seal between the pressurized volute and the rotating shaft. Examples of such pumps are found U.S. Pat. No. 5,288,215 to Chancellor et al. (the '215 patent). In the '215 designs all of the fluid within the pressurized volute is prevented from recirculating back into the impeller suction eye. This provides a high degree of operational efficiency relative to pumps that allow pumpate recirculation lose optimum design efficiency through the pumpate recirculation.

Mechanical seals in centrifugal pumps are plagued with design problems because such seals necessarily involve at least two lap seal finished faces rubbing against each other. In FIG. 1, for example, seal 172 rubs against seal 171, and such surfaces tend to wear out. This problem is especially acute where the pumpate includes suspended solids. Seal service life in conventional mechanical seals can also be reduced because of misalignment of the seal faces due to shaft deflection, and seal run out. One partial solution involves the placement of a "floating" or "intermediate" double faced seal between a rotating sealing surface and a stationary sealing surface. This can reduce the relative sliding speed between adjacent sealing surfaces to about one-half the speed encountered with a simple two-surface seal. Exemplary disclosures in this area are U.S. Pat. No. 4,351,533 to Moore and U.S. Pat. No. 4,266,786 to Weise. It is also known for seal designers to utilize a self-lubricating sealing material, which requires no lubricant. Such materials can be used as combination bearing-seals, and an example of such materials are described in U.S. Pat. No. 4,764,035 to Boyd.

Biasing of the seals against one another produces yet additional problems. Biasing is typically accomplished by spring loading one of the sealing surfaces, but may also be accomplished using another force such as fluid pressure as described in U.S. Pat. No. 4,707,150 to Graham Biasing of one sealing member against another is generally made axially but not radially.

It is known to incorporate several of the above-described improvements into a centrifugal pump having the first category of seals described above. The above-mentioned '215 patent, for example, describes a pump having an advanced axially biased floating seal. Despite all of these improvements, however, there is still a need to provide improved seals in a centrifugal pump. The above-described problems are largely echoed in other rotating shaft devices. Commonly used axles, for example, are typically supported by one or more lubricated bearings, which have sealing problems with respect to the lubricant.

3. SUMMARY OF THE INVENTION

The present invention provides for novel mechanical seals in which a non-rotating, axially slidable sealing member is biased against a sealing ring affixed to a rotating shaft.

In preferred embodiments the axial biasing, non-rotating sealing member additionally engages a second sealing member which is rotating with respect to the shaft. In particularly preferred embodiments relating to pumps, the biasing sealing members are positioned near the end of the motor housing or pump assembly, with a sealing ring interposed between a rolling bearing and the biasing sealing member.

4. BRIEF DESCRIPTION OF THE DRAWINGS

Various objects, features, aspects and advantages of the present invention will become more apparent from the following detailed description, in conjunction with the accompanying drawings, wherein like numerals represent like components.

5. DETAILED DESCRIPTION

Figure 1:
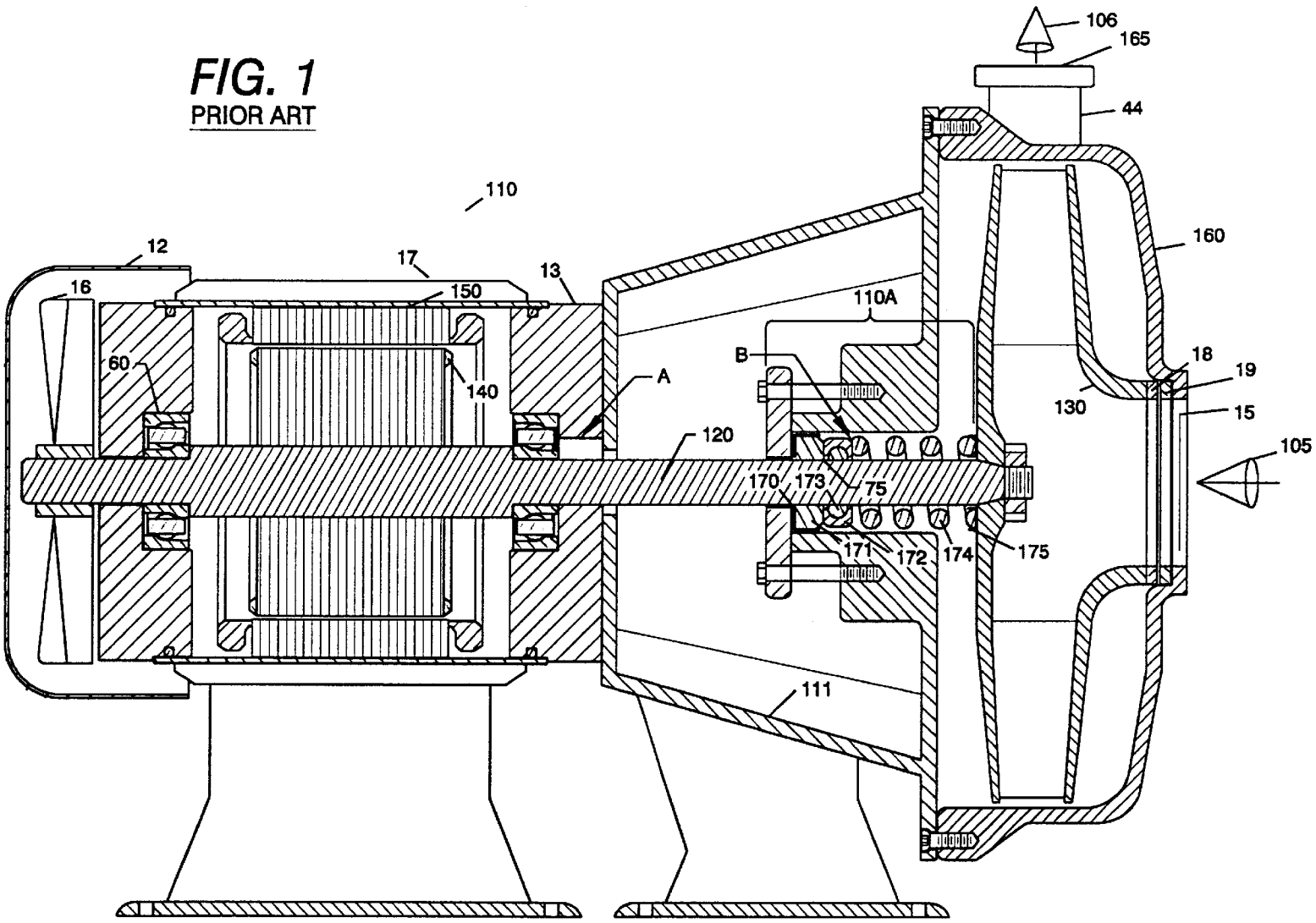
FIG. 1 PRIOR ART
FIG. 1 is a cross-sectional view of a prior art centrifugal pump with a prior art mechanical seal.

As described above, FIG. 1 depicts a generic prior art centrifugal pump 110 having an impeller 130 affixed to a rotating shaft 120. A rotor 140 is concentric about the rotating shaft 120, and a motor stator 150 is concentric about rotor 140. A volute 160 partially encloses impeller 130, and has outlet 44. Part 111 is used to attach volute 160 to a electric motor or other source of motive force. In operation, pumpate enters the pump through suction inlet 15 in the direction of arrow 105, and exits the volute 160 at arrow 106.

Turning now to additional details of the prior art device, a non-rotating wear ring 19 is used to mitigate damage to volute 160, a shaft speed wear ring 18 is used to mitigate damage to impeller 130, and a bearing assembly 60 is used to reduce rotating friction upon the rotating shaft. Shaft speed cooling fan 16 and fan shield 12 are used to force air across cooling fins 17 to cool rotor 140 and motor stator 150. End plate 13 is used to stabilize bearing assembly 60 and rotating shaft 120. Letters A and B depict logical locations of sealing points for conventional pump 110.

With respect to the seals, conventional mechanical seal 110A has non-rotating secondary seal 170 that seals non-rotating seal 171 and a rotating secondary seal 173 that seals rotating seal 172. Mechanical seal 171 and rotating seal 172 are seal face finished and rub together at point 75. Spring cup 175 helps stabilize rotating sealing pressure spring 174. Sealing point A is generally used to seal submersible pumps and sealing point B is generally used to seal vertical shaft pumps and horizontal pumps as shown in FIG. 1. Mechanical seals are used to prevent pumpate and other foreign matter from entering the motor or drive cavity.

Figure 2:
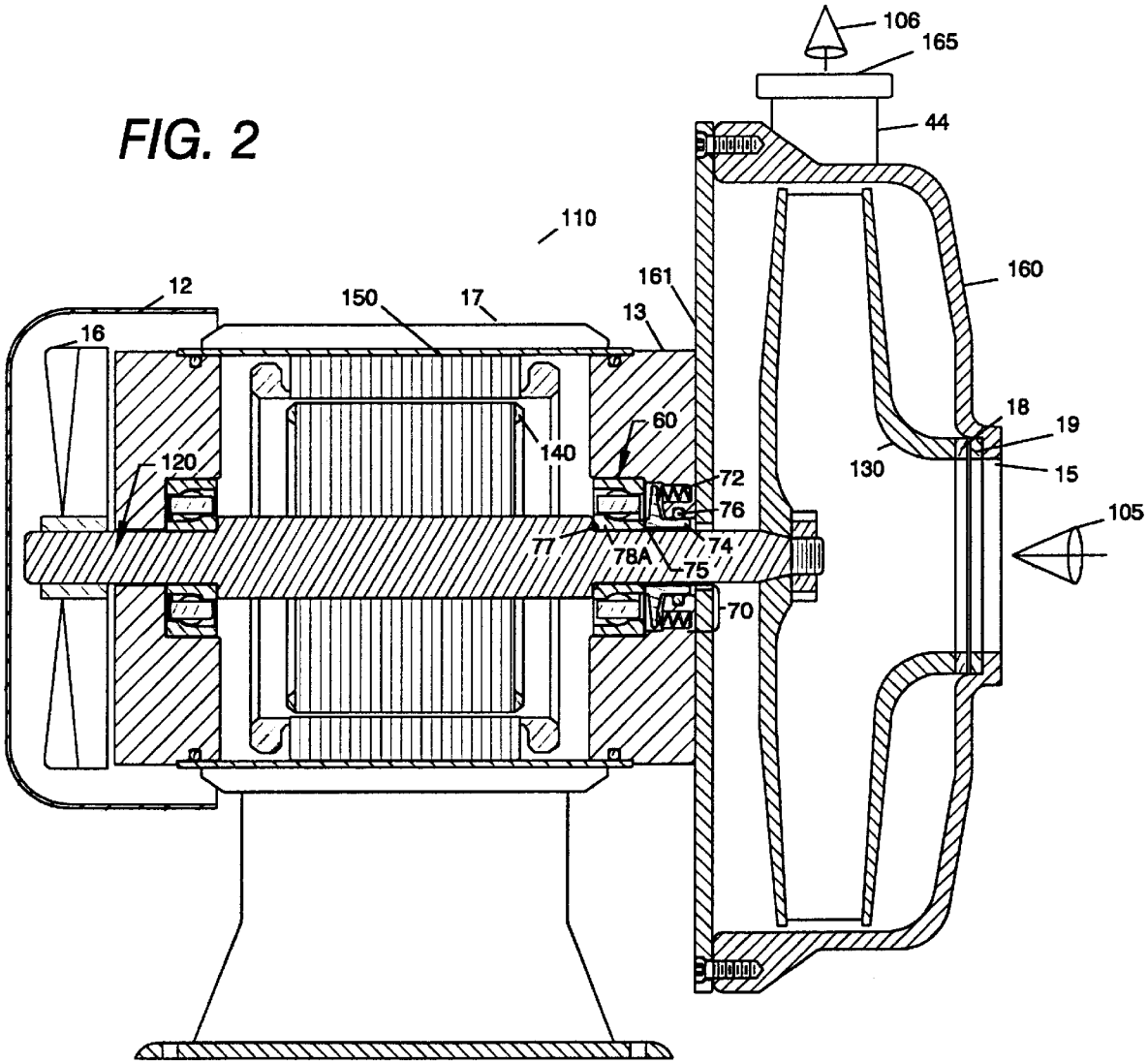
FIG. 2 is a cross sectional view of a centrifugal pump according to the present invention.

FIG. 2 shows a close coupled centrifugal pump 110 having a rotating shaft 120 with an impeller 130 affixed to rotating shaft 120. A rotor 140 is concentric about shaft 120, and a motor stator 150 is concentric about rotor 140. A volute 160 partially encloses impeller 130, and has outlet 44. Plate 161 is used to secure volute 160 to end plate 13. In operation pumpate enters the pump through suction inlet 15 in the direction of arrow 105, and leaves the volute in the direction of arrow 106. The non-rotating wear ring 19, the shaft speed wear ring 18, the bearing assembly 60, shaft speed cooling fan 16 and fan shield 12, and end plate 13 are substantially as described with respect to FIG. 1.

The sealing arrangement, however, is quite different from that shown above in that the mechanical seal 70 seals the motor or drive assembly from intrusion of pumpate and other foreign matter. To this end mechanical seal 70 has non-rotating secondary seal 76 that seals non-rotating mechanical seal 74, and seal 70 has a rotating seal 78A sealed by another rotating secondary seal 77. As presently contemplated, mechanical seal 74 and rotating seal 78A are each seal face finished and rub together at point 75, and non-rotating compression springs 72 exert axial sealing pressure on non-rotating seal 74 and seal 74 presses with sealing pressure against rotating seal 78A.

Figure 3:
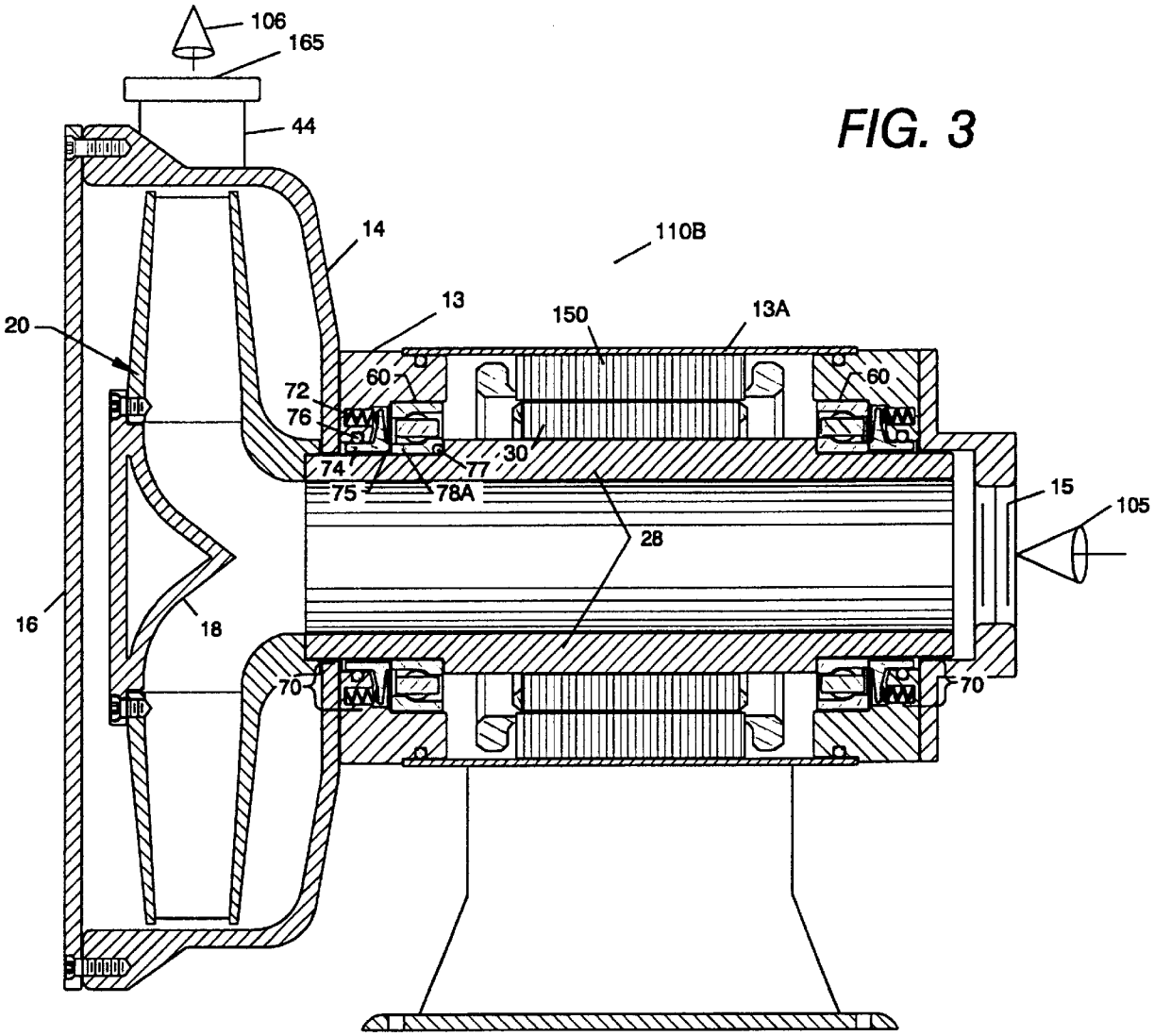
FIG. 3 is a cross sectional view of an alternative pump according to one aspect of the present invention.

FIG. 3 shows a preferred arrangement of the mechanical seal to the shaft 28, and a preferred arrangement of the bearing assemblies 60. This embodiment also specifically includes a hollow rotating shaft 28. The remaining components are substantially the same as discussed above with respect to FIG. 2.

Figure 4:
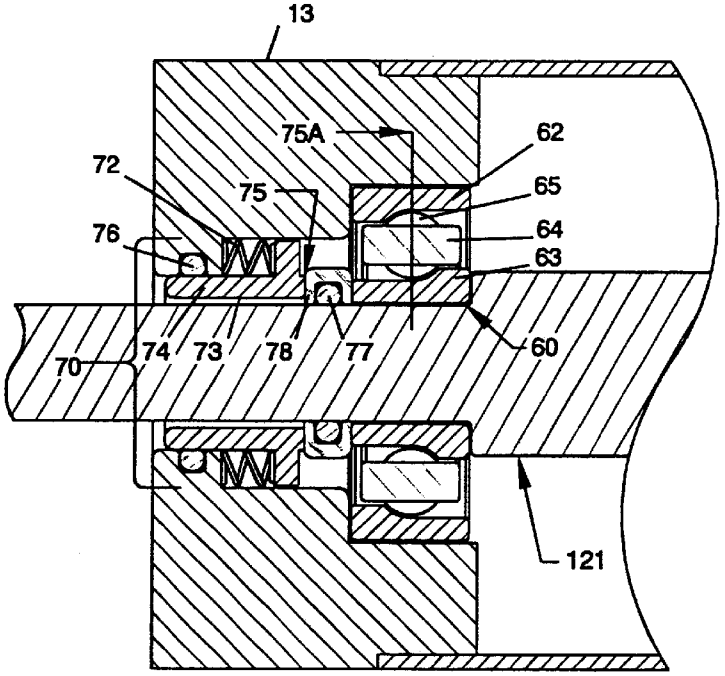
FIG. 4 is an enlarged cross sectional view of the preferred arrangement of a mechanical seal to the shaft and the bearing assembly according to one aspect of the present invention.

FIG. 4 shows a prefered arrangement of the mechanical seal to the shaft 121 and bearing assembly 60. The bearing 60 generally includes an outer race 62, an inner race 63, a bearing finger cage 64 and a rolling bearing 65. The seal 70 generally includes springs 72, and non-rotating mechanical seal 74 having a cooling surface 73, a non-rotating secondary seal 76. Rotating seal ring 78 is sealed by rotating secondary seal 77. The remaining components are substantially the same as discussed above with respect to FIG. 2.

It should be recognized that in this configuration, outer bearing race 62 is stationary with respect to end plate 13 as bearing 65 rotates within the bearing cage 64. Also, inner bearing race 63 rotates at shaft speed, and rotating seal ring 78 rotates at shaft speed and is sealed by rotating secondary seal 77.

Selection of the materials and specific dimensions to be used in FIG. 4 and other embodiments contemplated herein are well within the scope of those skilled in the art. For example, the spring 72 may advantageously be selected from known spring materials, including spring steel, stainless steel or rubber. The force exerted by such springs would advantageously fall within the range of 0.01 to 70 psi, depending upon the size of the turbo machine and the fluid pressures achieved. Similarly, seals 76 and 77 may advantageously be selected from known sealing materials, including rubber, elastomers, plastics or other known sealing materials.

One of the major advantages of the embodiment of FIG. 4 is that springs 72 are non-rotating. In conventional mechanical seals the biasing springs are rotated at shaft speed and may loose sealing pressure due to centrifugal forces on the springs. Another advantage that the springs 72 are not exposed to the pumpate. Pumpate may often contain caustic or fouling contaminants. Yet another advantage is that shaft deflection can be almost completely eliminated because mechanical seal point 75 may be designed to be close to the bearing fulcrum point 75A.

Figure 5:
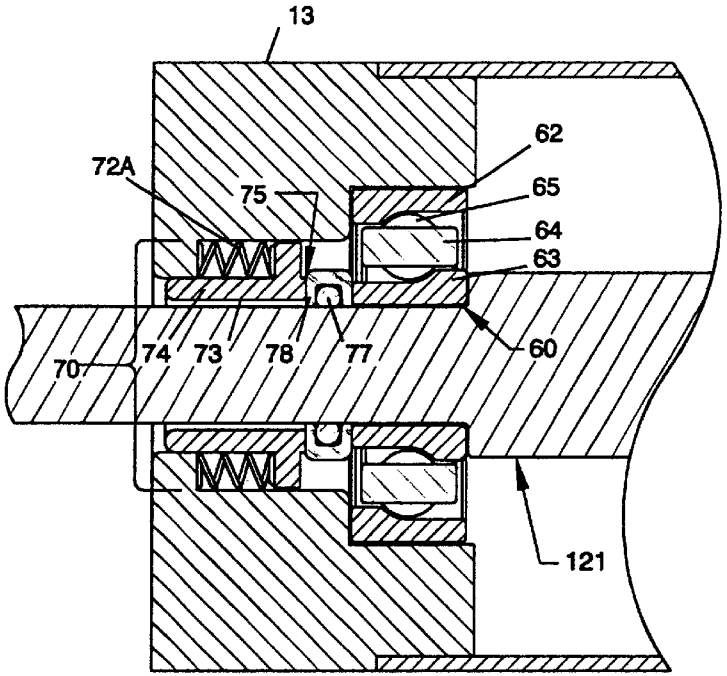
FIG. 5 is an enlarged cross sectional view of an alternative embodiment of a centrifugal pump and mechanical seal having a bellows spring according to one aspect of the present invention.

FIG. 5 shows a preferred embodiment including a bellows spring 72A. The remaining components are substantially the same as discussed above with respect to FIG. 2. Bellows spring 72A may advantageously be a rubber like substance that has been selected from known spring materials, including coated spring steel, coated stainless steel or even totally rubber.

One of the major advantages of the present embodiment is that bellows spring 72A is non-rotating. In conventional mechanical seals the biasing springs are rotated at shaft speed and may loose sealing pressure due to centrifugal forces on the springs. Another advantage is that a bellows spring 72A would facilitate simplicity of design.

Figure 6:
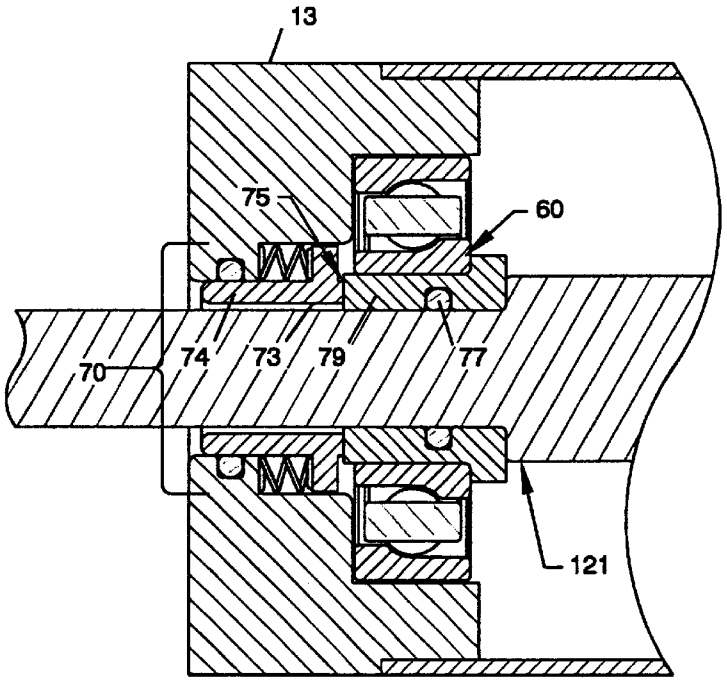
FIG. 6 is an enlarged cross sectional view of an alternative embodiment of a centrifugal pump and mechanical seal having a seal finished bearing seat according to one aspect of the present invention.

FIG. 6 shows a preferred embodiment including bearing collar 79 sealed by rotating secondary seal 77. The remaining components are substantially the same as discussed above with respect to FIG. 2. Bearing collar 79 may advantageously be seal face finished to provide a more compact assembly space for seal 70. Bearing collar 79 would help eliminate shaft deflection and seal face runout that are common in conventional mechanical seals.

Figure 7:
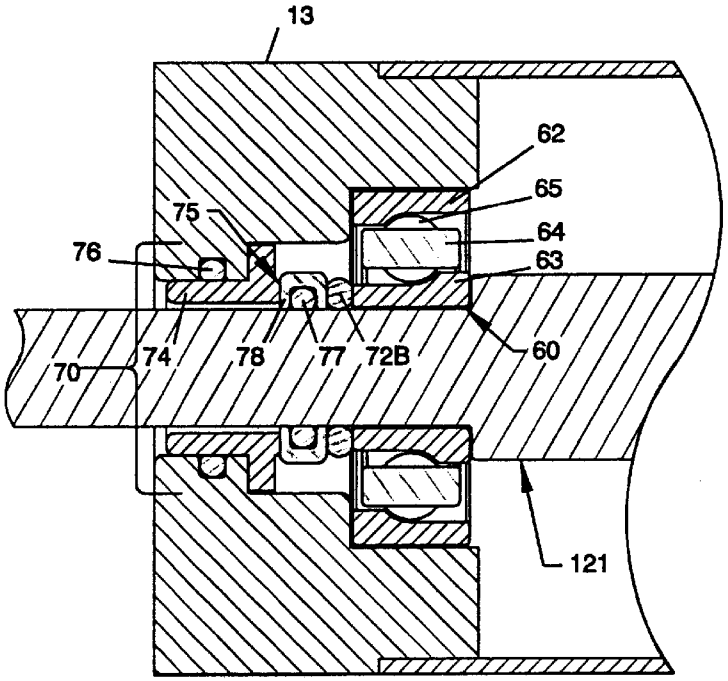
FIG. 7 is an enlarged cross sectional view of an alternative embodiment of a centrifugal pump and mechanical seal having an axial pressure spring between shaft stop and first seal face according to one aspect of the present invention.

FIG. 7 shows a preferred embodiment including an O-ring type biasing and sealing ring 72B, and a non axial moving, non-rotating mechanical seal 74. The remaining components are substantially the same as discussed above with respect to FIG. 2. Biasing and sealing ring 72B may advantageously be a rubber like substance that has been selected from known elastic materials, including plastics composite materials or even totally rubber. One of the major advantages of the present embodiment is that biasing and sealing ring 72B is simple and requires no adjustments for fast assembly and service. Another advantage is that a biasing and sealing ring 72B would facilitate simplicity of design.

Figure 8:
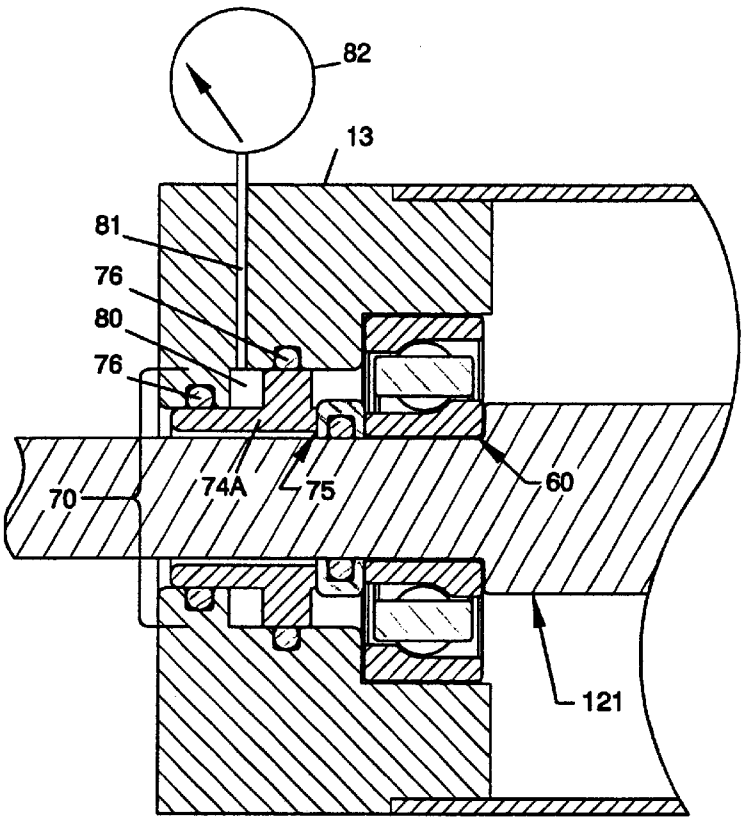
FIG. 8 is an enlarged cross sectional view of an alternative embodiment of a centrifugal pump and mechanical seal having an adjustable axial pressure device to allow variable seal face pressure according to one aspect of the present invention.

FIG. 8 shows a preferred embodiment including non-rotating seal 74A and pressure cavity 80. Pressure channel 81 will allow pressure adjustor 82 to exert adjustable pressure on point 75. Non-rotating seal 74A has two secondary non-rotating seals 76. The remaining components are substantially the same as discussed above with respect to FIG. 2.

Figure 9:
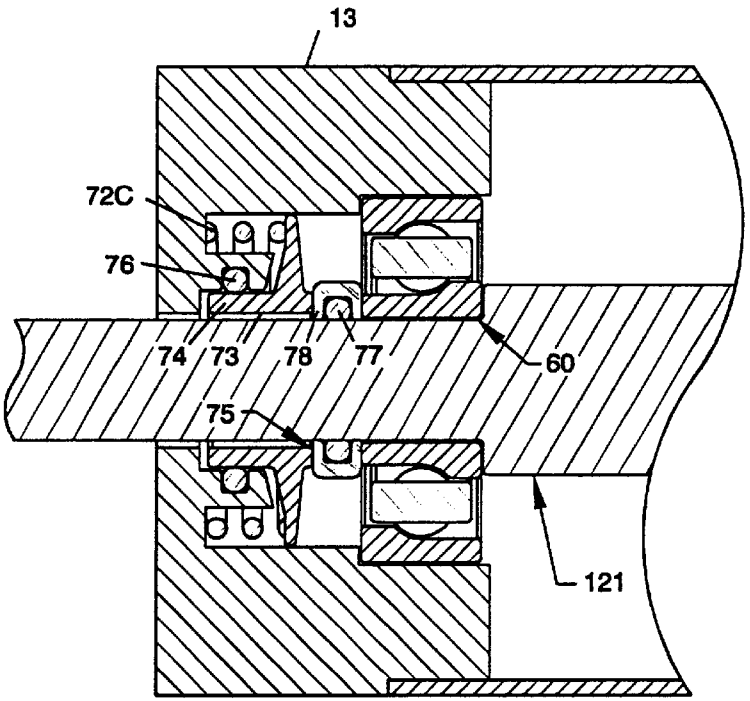
FIG. 9 is an enlarged cross sectional view of an alternative embodiment of a centrifugal pump and mechanical seal having a single spring providing seal pressure according to one aspect of the present invention.

FIG. 9 shows a preferred embodiment including a single axial pressure spring 72C. A single pressure spring 72C will allow simplicity of design and eliminate service adjustments. Spring 72C may be made from existing materials such as spring steel, stainless steel or rubber and plastic elastomers. Single spring 72C would help eliminate seal face runout that are common in conventional mechanical seals. The remaining components are substantially the same as discussed above with respect to FIG. 2.

Figure 10:
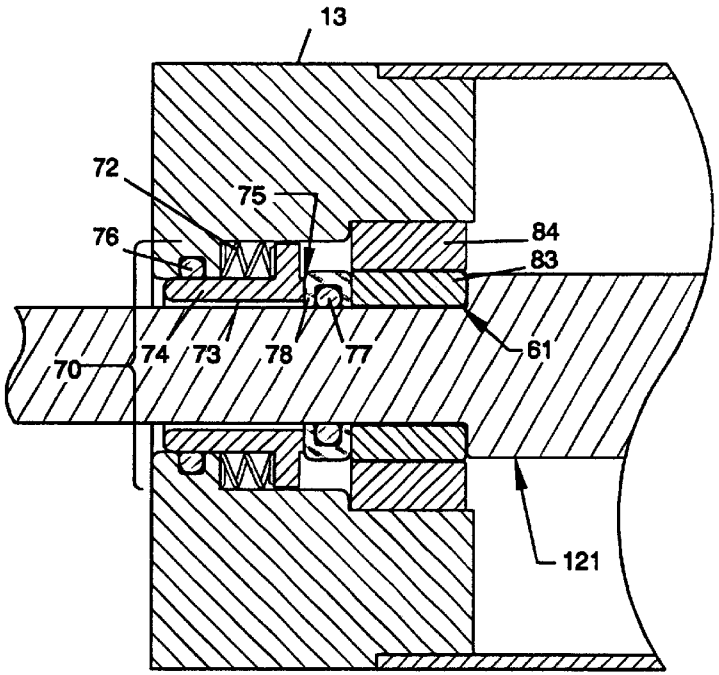
FIG. 10 is an enlarged cross sectional view of an alternative embodiment of a centrifugal pump and mechanical seal in which bushings are used as bearings according to one aspect of the present invention.

FIG. 10 shows a preferred embodiment including a shaft speed bushing 83 and non-rotating bushing 84. Bushings 83 and 84 are shown as an alternate bearing assembly to bearing assembly 60 already described in FIG. 4. The remaining components are substantially the same as discussed above with respect to FIG. 2.

Figure 11:
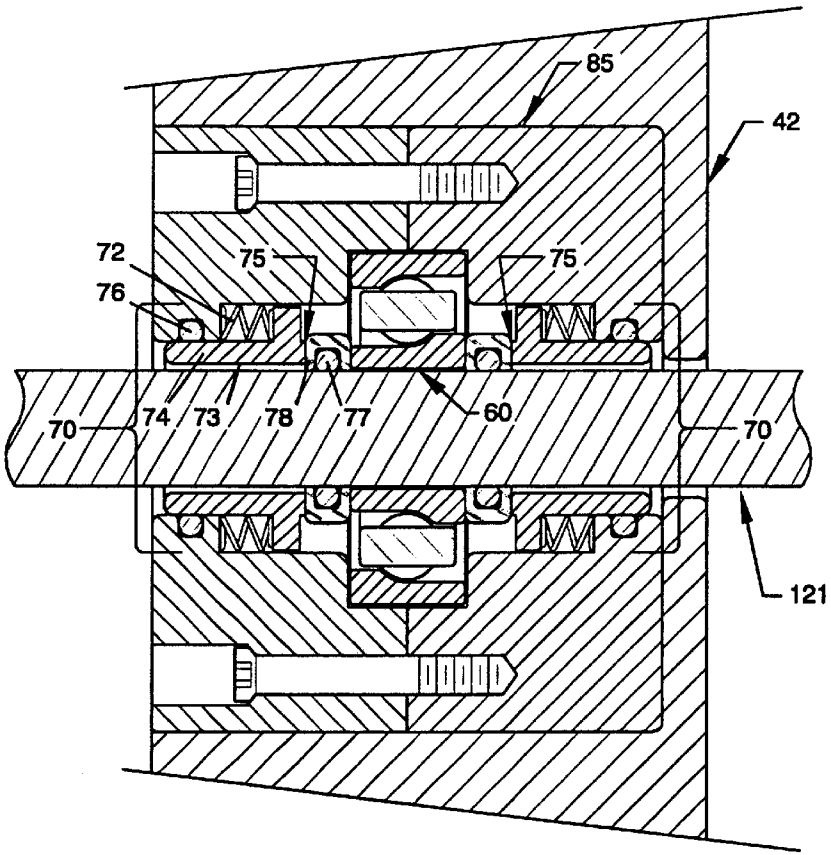
FIG. 11 is an enlarged cross sectional view of an alternative embodiment of a centrifugal pump and mechanical seal having double mechanical seals according to one aspect of the present invention.

FIG. 11 shows a preferred embodiment including a mounting assembly 85 and a vessel wall 42. This embodiment may be used in marine applications to seal propeller shaft bearings from seawater on one side and bilge water on the other. Bushings 83 and 84 are shown as an alternate bearing assembly to bearing assembly 60 already described in FIG. 4. The remaining components are substantially the same as discussed above with respect to FIG. 2. It is contemplated that the present configuration may advantageously be used in pulp mills and mixing vats or other hard to seal applications.

Figure 12:
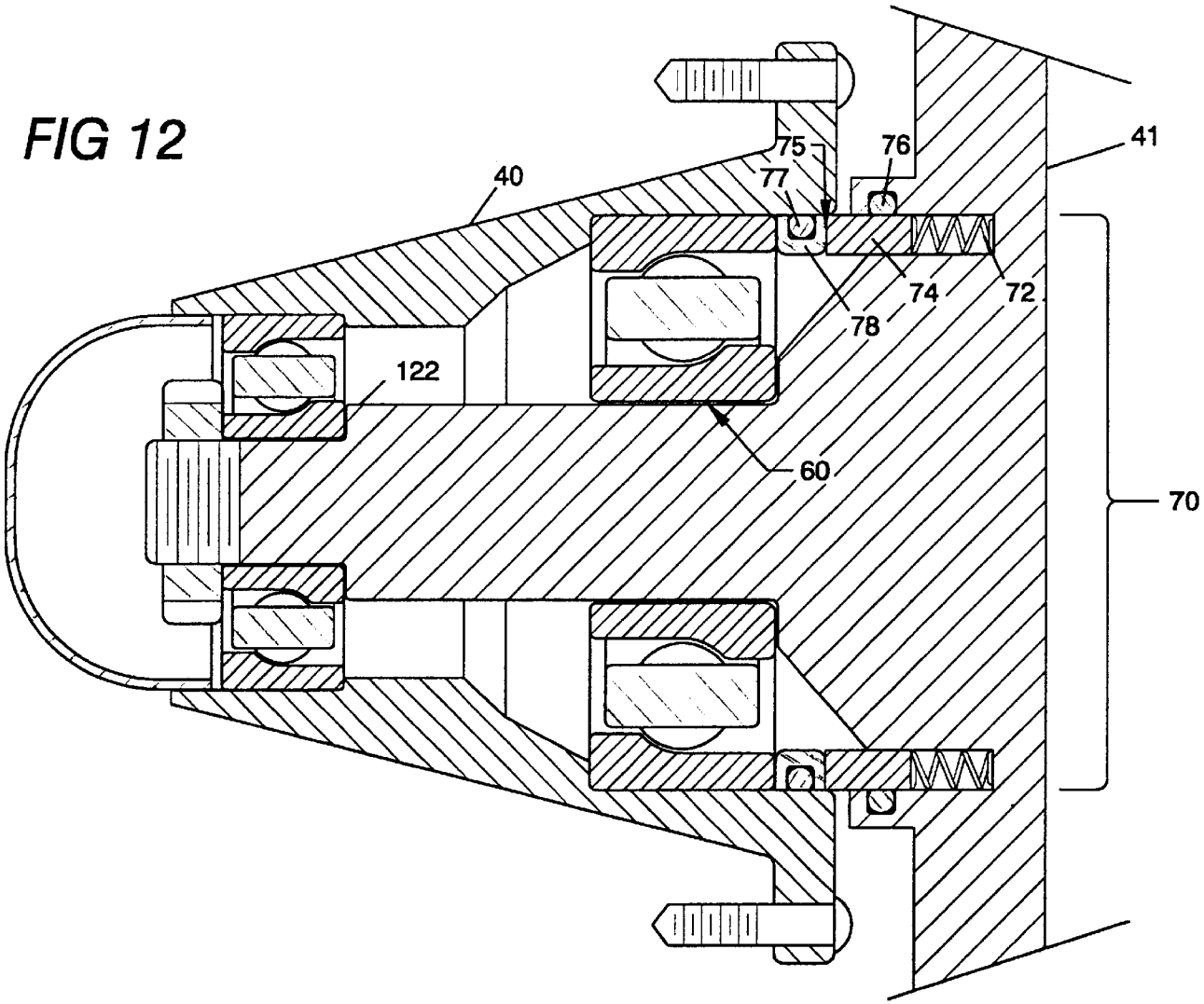
FIG. 12 is an enlarged cross sectional view of a generic axle machine and mechanical seal according to one aspect of the present invention.

In FIG. 12 shows a preferred embodiment including an outside rotating hub 40 rotating around axle 122. This axle configuration may include a spindle 41 for a front vehicle wheel It is contemplated that the present configuration may advantageously help seal vehicle axles from dust and other harmful debris if they are emersed in water of mud.

It should be apparent to those skilled in the art that many additional embodiments of the present invention beyond those depicted would be consistent with the teachings herein. For example, the sealing member could be biased towards the volute rather than away from it, by positioning the rotating O-ring between the volute and the sealing member. As another example, it may be desirable to position the bearing between the sealing member and the volute, especially where the pumpate is a suitable lubricating fluid. As still another example, what is referred to herein as an O-ring need not have a typical O-ring shape.

Thus, while specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An improved centrifugal pump having a motor housing containing a hollow shaft, the shaft coupled to a rotor and an impeller such that the shaft, rotor and impeller rotate together to propel a fluid along a pumpate flow path inside the shaft, the improvement comprising:

a bearing assembly having a rotating portion that rotates with the shaft, and a non-rotating portion that doesn't rotate with the shaft, the bearing assembly disposed outside the pumpate flow path;

a non-rotating sealing member which is axially slidable with respect to the shaft, a surface of said slidable sealing member biased against a surface of the rotating portion of the bearing assembly to form a seal; and a non-rotating secondary seal that seals the non-rotating sealing member and that is not directly contacting the bearing assembly.

2. The improved pump of claim 1 further comprising a spring which biases the slidable sealing member against the surface of the rotating portion of the bearing assembly, the spring not rotating with the shaft.

3. The improved pump of claim 1 wherein the slidable sealing member is substantially "L" shaped.

4. In a centrifugal pump including an impeller contained within a volute having an inlet and an outlet, a hollow shaft partially contained within a housing and carrying a pumpate within the hollow, the shaft rotatably coupled to the impeller and passing through the inlet, a method of sealing off a passageway between the volute inlet and the shaft comprising:

positioning a sealing ring around a portion of the shaft such that the sealing ring directly contacts and rotates with the shaft;

providing a non-rotating sealing member within the housing, said sealing member axially slidable with respect to the shaft;

biasing the slidable sealing member against the sealing ring to form a seal; and providing a bearing assembly adjacent the rotating sealing member.

5. The method of claim 4 further further comprising biasing the slidable sealing member with a spring which does not rotate with the shaft.

6. The method of claim 4 further comprising supporting the shaft in a rolling bearing and positioning the sealing ring between the rolling bearing and the slidable sealing member.

7. The method of claim 4 further comprising providing the slidable sealing member with a substantially "L" shape.

* * * * *